US005909759A

United States Patent [19]

Tanaka et al.

[11] Patent Number: 5,909,759

[45] Date of Patent: Jun. 8, 1999

[54] STOWABLE NESTING HANDLE CONSTRUCTION

[75] Inventors: Kazuna Tanaka, Cos Cob; Jeffrey Kapec, Westport, both of Conn.; Yukiko Naoi, New York, N.Y.

[73] Assignee: Franzus Company, Inc., Beacon Falls, Conn.

[21] Appl. No.: 08/984,671

[22] Filed: Dec. 3, 1997

[51] Int. Cl.[6] ..... A47B 95/02

[52] U.S. Cl. ..... 16/112; 16/115; 16/126

[58] Field of Search ..... 16/112, 115, 126, 16/DIG. 12, DIG. 18, DIG. 19; 74/551.3, 551.9; 200/755, 761, 757, 760

[56] References Cited

U.S. PATENT DOCUMENTS

| | | | |
|---|---|---|---|
| 1,374,126 | 4/1921 | Walter . | |
| 2,306,099 | 12/1942 | Wiepert | 16/126 |
| 2,323,094 | 1/1943 | Levin | 16/126 |
| 3,115,229 | 12/1963 | Erhard . | |
| 3,265,168 | 8/1966 | Erhard . | |
| 4,189,037 | 2/1980 | Szabo | 16/126 |
| 5,213,028 | 5/1993 | Chang | 16/126 |

*Primary Examiner*—Chuck Y. Mah
*Attorney, Agent, or Firm*—Melvin I. Stoltz

[57] ABSTRACT

By providing a pair of handle forming members and independently mounting the handle forming members to a desired product in a manner which enables the handle forming members to independently pivot while still cooperating to form a single gripping handle, a unique handle assembly is attained which is capable of being stowed in nested engagement with the product as an integral, co-extensive portion thereof. In the preferred embodiment, each handle forming member has a pair of arm portions mounted to the product with the arm portions being interleaved with each other to provide a compact stowed position, while being easily pivoted from the stowed position to an extended, handle forming position.

15 Claims, 6 Drawing Sheets

STOWABLE NESTING HANDLE CONSTRUCTION

TECHNICAL FIELD

This invention relates to handle constructions for use on portable or movable products and, more particularly, to handles constructed for being movable from a compact, stowed position to a fully extended, easily accessible position.

BACKGROUND ART

A wide variety of consumer-oriented products incorporate handles for enabling the user to employ the particular product in the most convenient manner. In many products, handles are fixedly mounted to the product and remain immovable relative to the product.

Other consumer products which are employed intermittently or are constructed for traveling have found fixedly mounted handles to be extremely inconvenient, due to the additional space taken between the body of the product and the handle itself. Consequently, many of these products are constructed with handles which can be pivoted between a stowed position and a use position. Although a wide variety of products fall within this group, such products are typified by electronic convenience items such as clothes irons, garment steamers, and the like.

In these prior art products, attempts have been made to manufacture the products in a way which will enable the handles to be moved into a position which would reduce the packing space required for storing the particular products in a suitcase. However, although the goal of achieving a product with a handle construction which is foldable or stowable for occupying a minimum area, while still being easily movable into an operative position which enables the handle to be easily accessed and employed, prior art constructions have failed to achieve handle constructions which fully meet all of the consumers desires and demands.

In this regard, most prior art handle constructions, which have attempted to meet consumer desires, have resulted in handle constructions which are bulky, occupy more space than desired by the consumer, and/or are difficult to move between a folded position and a use position. Consequently, these products have failed to satisfy the consumer demands for an improved handle construction.

Therefore, it is a principal object of the present invention to provide a handle construction which is fully stowable in an unused position as an integral part of the product to which the handle assembly is affixed while also being quickly and easily moved from the stowed position to a readily accessible use position.

Another object of the present invention is to provide a handle construction having the characteristic features described above which provides a readily accessible handle when pivoted to its use position which is easily accessed by the consumer and is spaced away from the product to prevent unwanted contact with surfaces that may cause injuries to the consumer.

Another object of the present invention is to provide a handle construction having the characteristic features described above which is quickly and easily movable between its two alternate positions, enabling consumers to attain the benefits of the stowed position or use position in an easily employable, readily attainable manner.

Other and more specific objects will in part be obvious and will in part appear hereinafter.

SUMMARY OF THE INVENTION

By employing the present invention, all of the difficulties and drawbacks of the prior art handle constructions are eliminated and a readily usable, easily employed, fully stowable, nestable handle construction is achieved. In the present invention, these previously unattainable goals are realized by providing a handle construction incorporating two cooperating components which are pivotally mounted to a surface of the particular product, enabling the components to independently, arcuately pivot relative to each other from an extended position, wherein the handle is assembly is usable, to a stowed position, wherein the handle assembly is in nested engagement with the surface of the product.

In the preferred embodiment of the present invention, the handle forming members of the handle assembly each comprise a grip forming portion and two juxtaposed, spaced cooperating arm portions interconnected to the grip forming portion. Preferably one end of each arm portion is mounted to the grip forming portion while the opposed ends of each arm portion are mounted directly to the product to which the handle assembly is associated in a manner which enables each handle forming member to arcuately pivot relative to the surface to which the handle forming members are mounted. In this way, the handle forming members are capable of being moved between a stowed position and an extended position, wherein the grip forming portion of each handle forming member cooperate to form a gripping zone readily accessible by the user for holding and using the particular product in the desired manner.

In order to provide a uniquely constructed, stowed position for each handle forming member and enable each handle forming member to be arcuately pivoted, whenever desired, from the stowed position to the extended position, the preferred embodiment of the present invention positions the arm portions of each handle forming member in an overlying, interleaved, cooperating construction. This construction enables the handle forming members to be stored with a minimum of space, in nested, mounted engagement with the surface of the product to which the handle forming members are pivotally mounted as well as be easily pivoted into an extended use position. In this way, the handle assembly of the present invention attains a unique construction enabling the handle forming members thereof to be stored in nested interengagement with the surface of the product in a virtual hidden configuration mounted with the product as an integral component thereof.

In the preferred embodiment, in addition to maintaining the arm portions of each handle forming member of the handle assembly in an overlying, interleaved, cooperating relationship, the distal ends of each arm portion are pivotally mounted to the surface of the product in a manner which establishes the pivot axis of the first arm portion to be in juxtaposed, spaced, relationship with the pivot axis of the second arm portion. In addition, in the preferred construction, the spaced distance between the pivot axes of the handle forming members is substantially equivalent to the overall length of the arm portion of handle forming members.

By constructing the handle assembly in the manner detailed above, the arcuate cooperating pivoting relationship of the handle forming members is attained, with each of the handle forming members being stowable in nested interengagement with the surface of the product to which it is mounted. In addition, a fully compacted, stowed handle assembly is realized by mounting the arm portions in an interleaved cooperating relationship, nested into the surface of the product, with the grip forming portion of each handle forming member positioned in juxtaposed, spaced, relationship to each other and in nested engagement with the surface of the product.

In this way, in the stowed position, a minimum of space is employed and virtually complete, nested, secured engagement of the handling forming members with the surface of the product is attained. The handle forming members are virtually formed as a part of the surface of the component, with minimal visibility and without any undesirable protrusion or extra space being occupied. Furthermore, by employing this construction, each of the handle forming members is easily arcuately pivoted from its stowed position to its extended position, wherein the grip forming portions are mounted in interconnected, cooperating engagement forming the grip surface for the user to employ the product whenever desired.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 2:
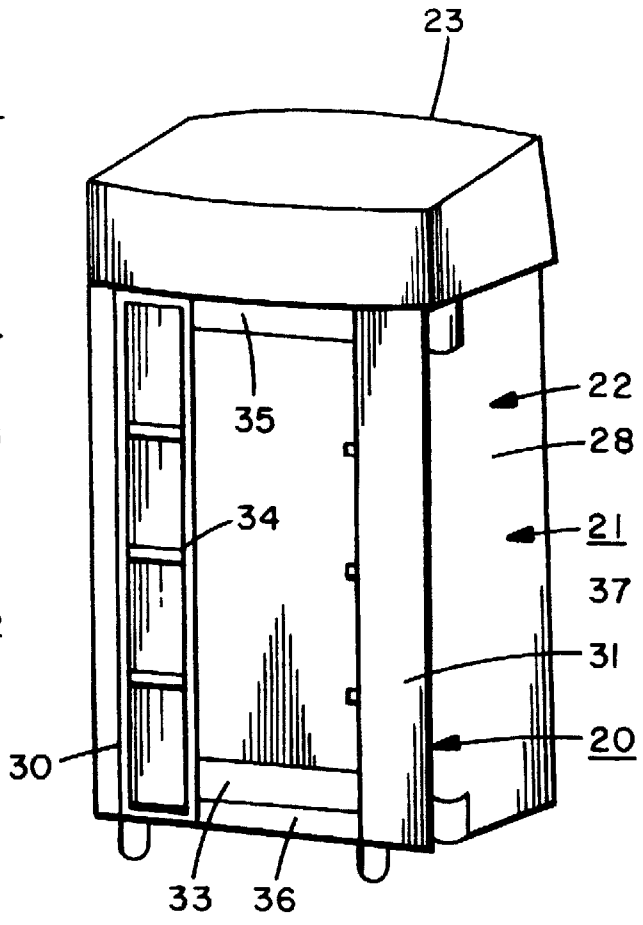
FIG. 2 is a perspective view of the handle construction of the present invention shown in its fully stowed, nested position in cooperating association with the garment steamer.
Figure 1:
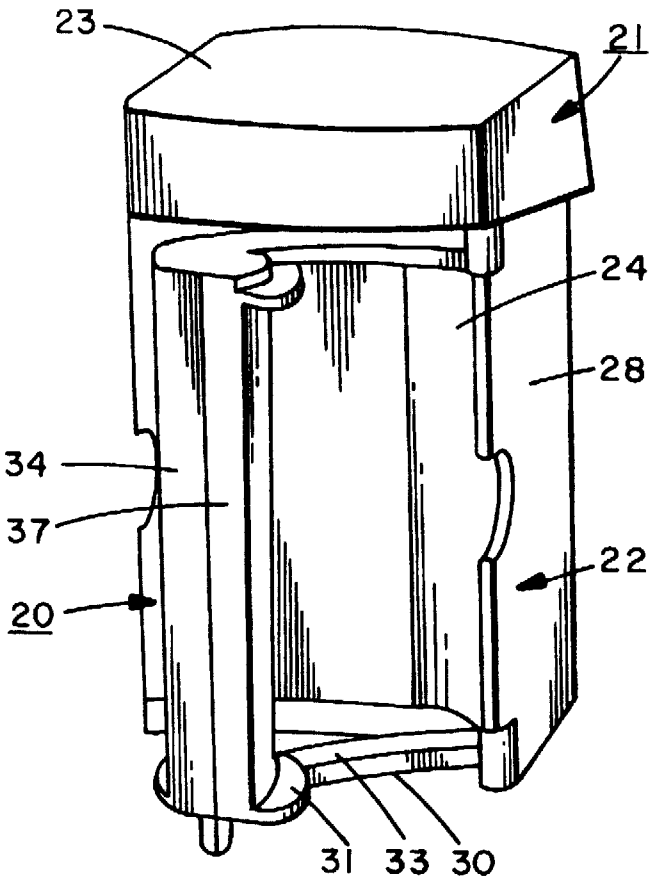
FIG. 1 is a perspective view of the handle construction of the present invention mounted to a garment steamer and positioned in its fully deployed, ready-to-use position.

By referring to FIGS. 1–11 along with the following detailed disclosure, the construction and operation of handle assembly 20 of the present invention can best be understood. Throughout these drawings, handle assembly 20 is depicted as being pivotally mounted to garment steamer 21. However, it is to be understood that garment steamer 21 is employed as one example of a consumer product with which handle assembly 20 of the present invention can be pivotally mounted. Consequently, the inclusion of garment steamer 21 in the drawings as well as in the following detailed disclosure is intended for exemplary purposes only and is not intended to limit the present invention in any way.

As depicted, garment steamer 21 comprises a generally conventional construction incorporating a body portion 22 and a removable head portion 23. Head portion 23 is removed in order to gain access into the interior of body portion 22, in the conventional manner, in order to enable the user to add water to body portion 22 and produce the desired steam for employing garment steamer 21 in association with wrinkled clothing.

Body portion 22 of garment steamer 21 incorporates a rear surface 24 to which handle assembly 20 is mounted, a top surface 25, a bottom surface 26, front surface 27 and side surfaces 28, 28. As detailed below, by employing handle assembly 20, the desired use and controlled movement of garment steamer 21 over the clothing to be steamed is easily attained.

As shown throughout the figures, handle assembly 20 preferably comprises handle forming members 30 and 31 each of which are pivotally mounted to rear surface 24 of steamer 21. In its preferred embodiment, handle forming member 30 comprises arm members or portions 32 and 33 and a grip forming portion 34. Similarly, handle forming member 31 comprises arm members or portions 35 and 36 and a grip forming portion 37.

In the preferred construction, arm portions 32 and 33 of handle forming member 30 are mounted at opposed ends of grip forming portion 34 in juxtaposed, spaced parallel relationship to each other. Similarly, arm portions 35 and 36 of handle forming member 31 are mounted to opposed ends of grip forming portion 37 in juxtaposed, spaced, parallel relationship to each other.

Figure 10:
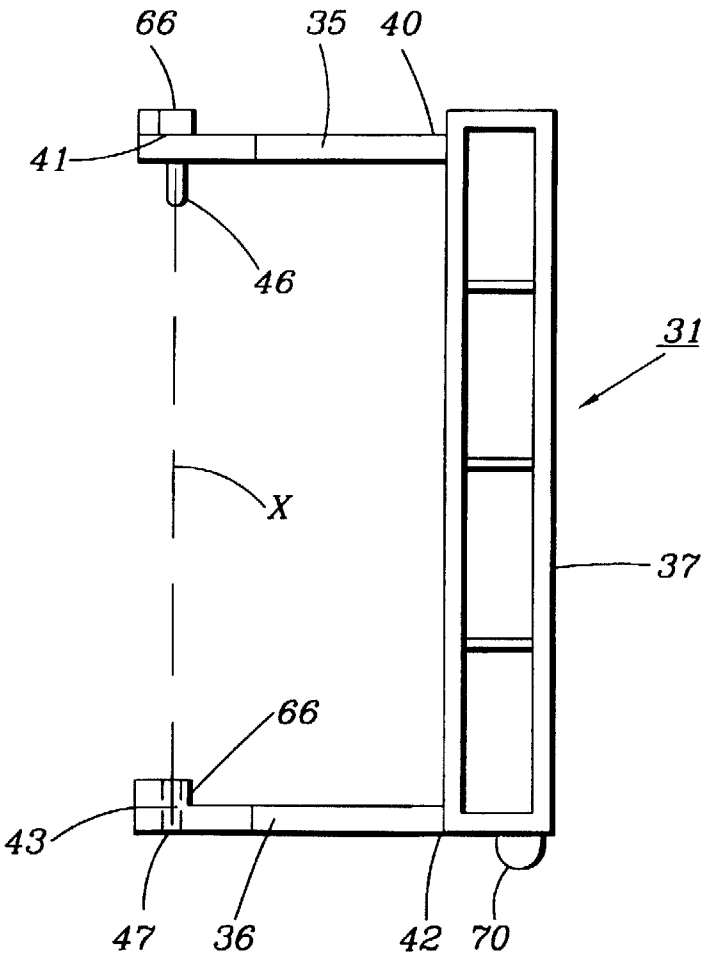
FIG. 10 is a side elevation view of one handle forming member of the handle assembly of the present invention.
Figure 11:
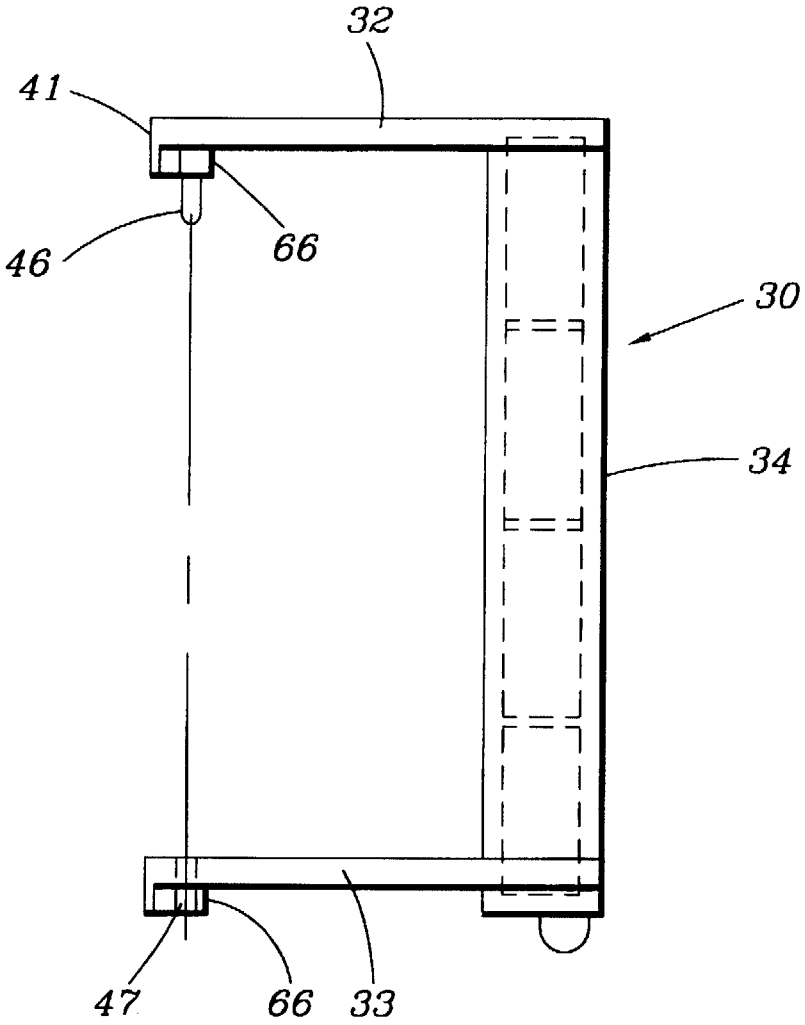
FIG. 11 is a side elevation view of the second handle forming member of the handle assembly of the present invention.

As best seen in FIGS. 7–11, in order to attain this construction, arm portions 32 and 35 each incorporate a proximal end 40 and a distal end 41. Similarly, arm portions 33 and 36 each comprise a proximal end 42 and a distal end 43. In order to attain the desired construction, proximal ends 40 and 42 of arm portion 32, 33, 35, and 36 are integrally interengaged with its associated grip forming portion 34 and 37. As a result, distal ends 41 and 43 of arm portion 32, 33, 35, and 36 comprise free ends, as best seen in FIGS. 10 and 11.

Figure 9:
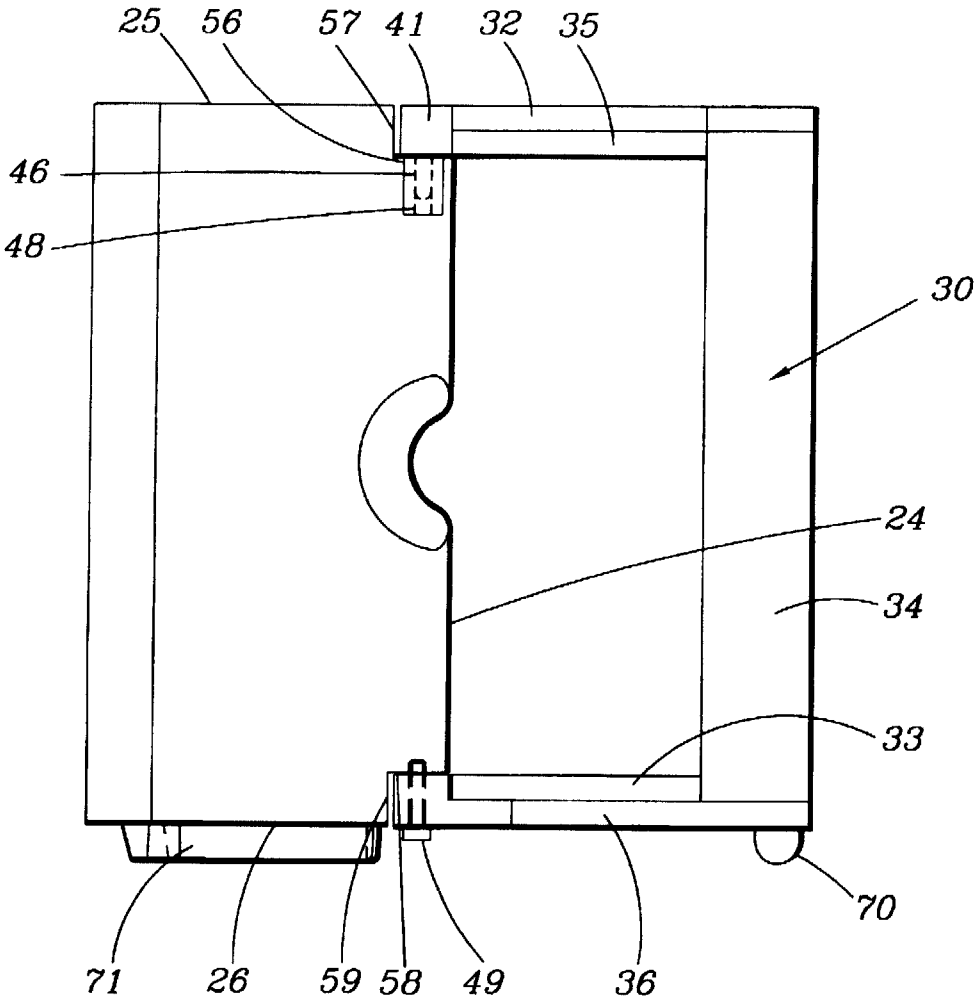
FIG. 9 is a side elevation view of the handle construction mounted to the garment steamer and fully deployed as shown in FIG. 8.

In the preferred construction, as depicted in FIGS. 9, 10, and 11, arm portion 32 of handle forming member 30 and arm portion 35 of handle forming member 31 each comprise a pivot pin 46 formed at distal end 41 thereof. In addition, arm portion 33 of handle forming member 30 and arm portion 36 of handle member 31 each comprises a threaded aperture 47 formed in each distal end 43 thereof. Furthermore, in the preferred embodiment, the central axis of pin 46 is aligned with the central axis of threaded aperture 47, thereby forming a pivot axis "X" as depicted in FIGS. 10 and 11.

Figure 7:
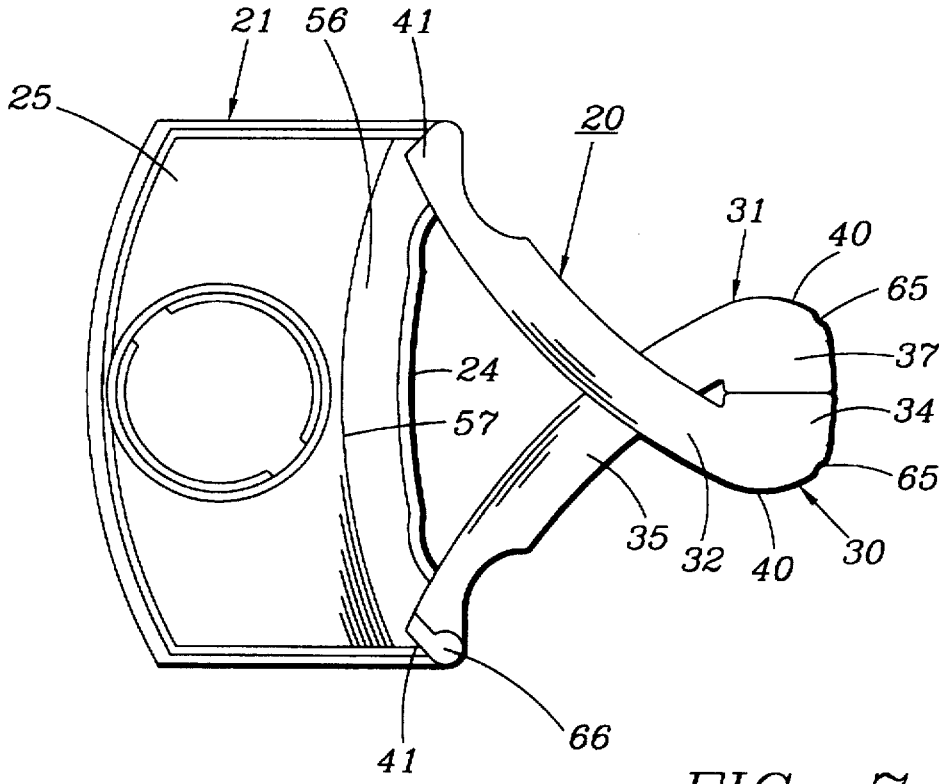
FIG. 7 is a top plan view, similar to FIG. 5, wherein the handle construction is depicted in its fully deployed position.
Figure 8:
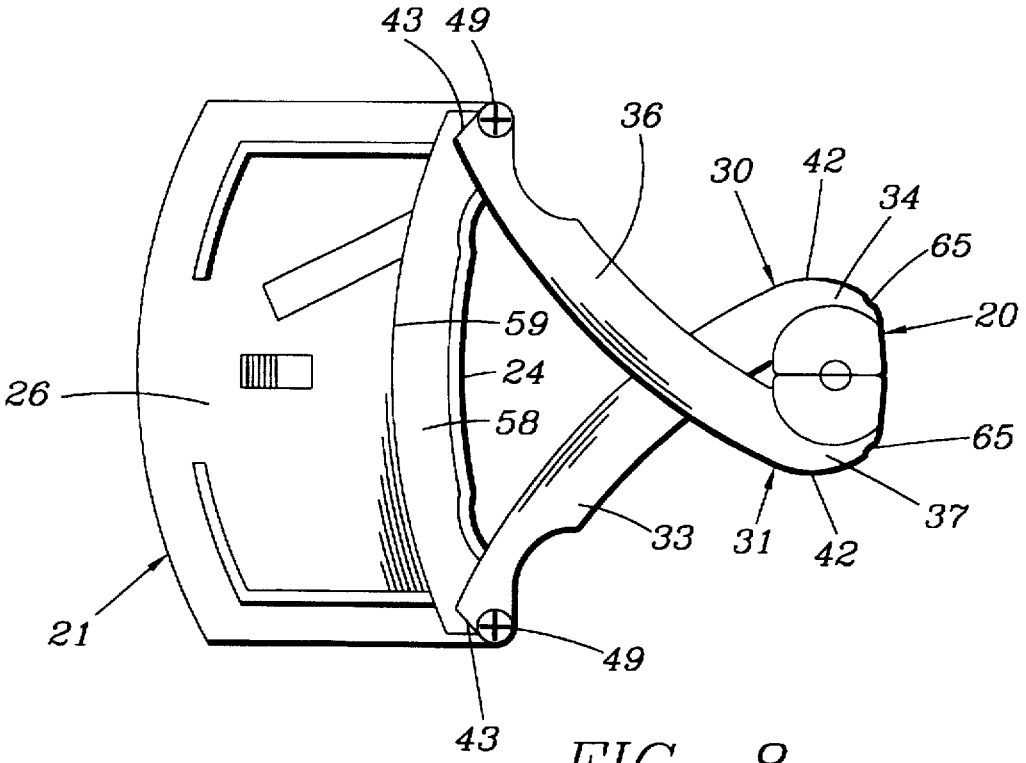
FIG. 8 is bottom plan view, similar to FIG. 6, depicted with the handle construction in its fully deployed configuration.

As best seen in FIGS. 7, 8, and 9, handle assembly 20 of the present invention is pivotally mounted to garment steamer 21 by mounting pin 46 of arm member 32 in a receiving hole 48 formed in steamer 21 in association with the juncture between top surface 25 and rear surface 24 thereof. This pivotal mounting of arm portion 35 is best seen in FIG. 9, with arm portion 31 being mounted on the opposed end of rear surface 24 and top surface 25 in a substantially identical manner. In addition, distal end 43 of arm portions 33 and 36 are pivotally mounted to steamer 21 by threadedly engaging distal end 43 of arm portions 33 and 36 to steamer 21 by mounting fastening means 49 through aperture 47 into bottom surface 26 at its juncture with rear surface 24.

By employing this construction, arm portion 30 of handle assembly 20 is pivotally mounted on one side of rear surface 24 with arm portions 32 and 33 thereof, as well as grip forming portion 34, being pivotal relative to garment steamer 21 about pivot axis X defined by pivot pin 46 and threaded aperture 47. Similarly, handle forming member 31 is pivotally mounted to garment steamer 21 about an opposed end of surface 24, with grip forming portion 37 and arm portions 35 and 36 being pivotal about pivot axis X as established on the opposed edge of surface 24 of garment steamer 21.

In order to attain the desired compact, folded, nested, fully stowed, mounted engagement of handle assembly 20 with garment steamer 21, arm portion 32 of handle forming member 30 is positioned in overlying, interleaved, cooperating relationship with arm portion 35 of handle forming member 31. Similarly, arm portion 33 of handle forming member 30 is placed in overlying, interleaved, cooperating relationship with arm portion 36 of handle forming member 31. This cooperating, overlapping, interleaved, interrelationship can best be seen in FIGS. 1, 4, and 7–9.

In the preferred construction, arm portions 32 and 35 are placed in overlying, sliding, cooperating, interleaved relationship with each other, with each arm portion 32 and 35 lying in a separate and distinct plane, with both planes thereof in juxtaposed, spaced, parallel relationship with each other. Similarly, arm portions 33 and 36 are also positioned in overlying, interleaved, sliding, interengagement with each other, with each arm portion lying in a separate plane with said planes being parallel to each other in close, juxtaposed, spaced, parallel relationship. In this way, the desired compact, stowable handle assembly is attained.

Figure 4:
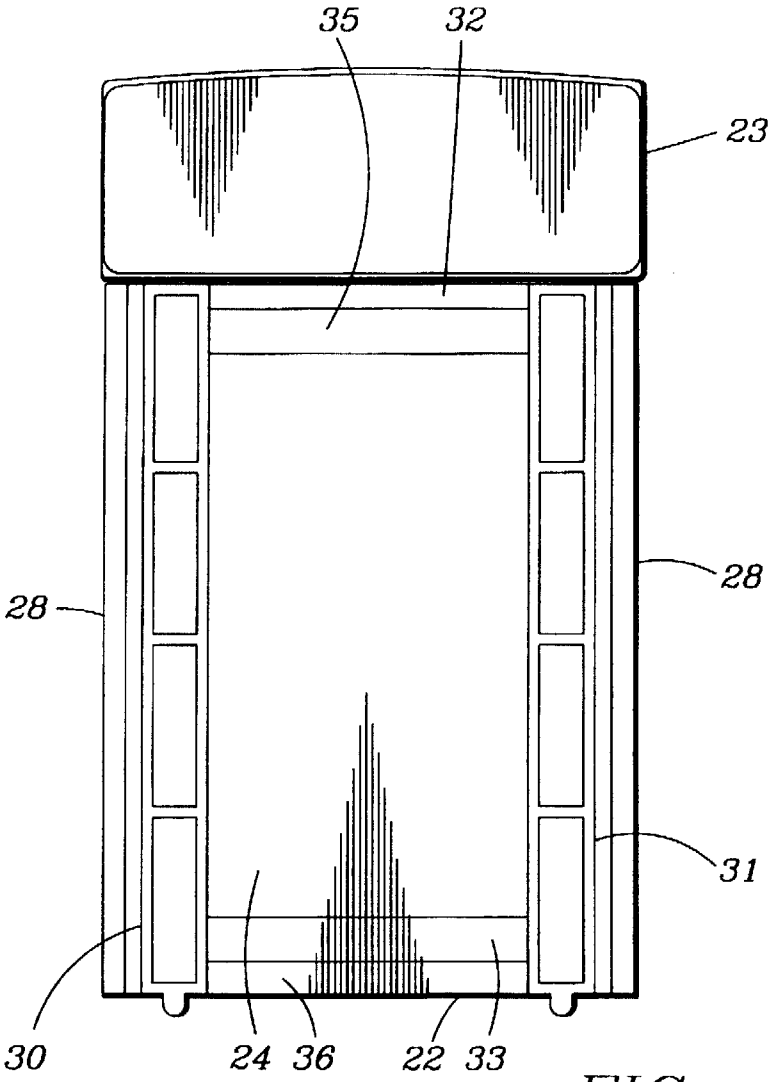
FIG. 4 is a rear elevation view depicting the fully stowed, nestable handle construction of the present invention in its stowed position as shown in FIG. 2.
Figure 3:
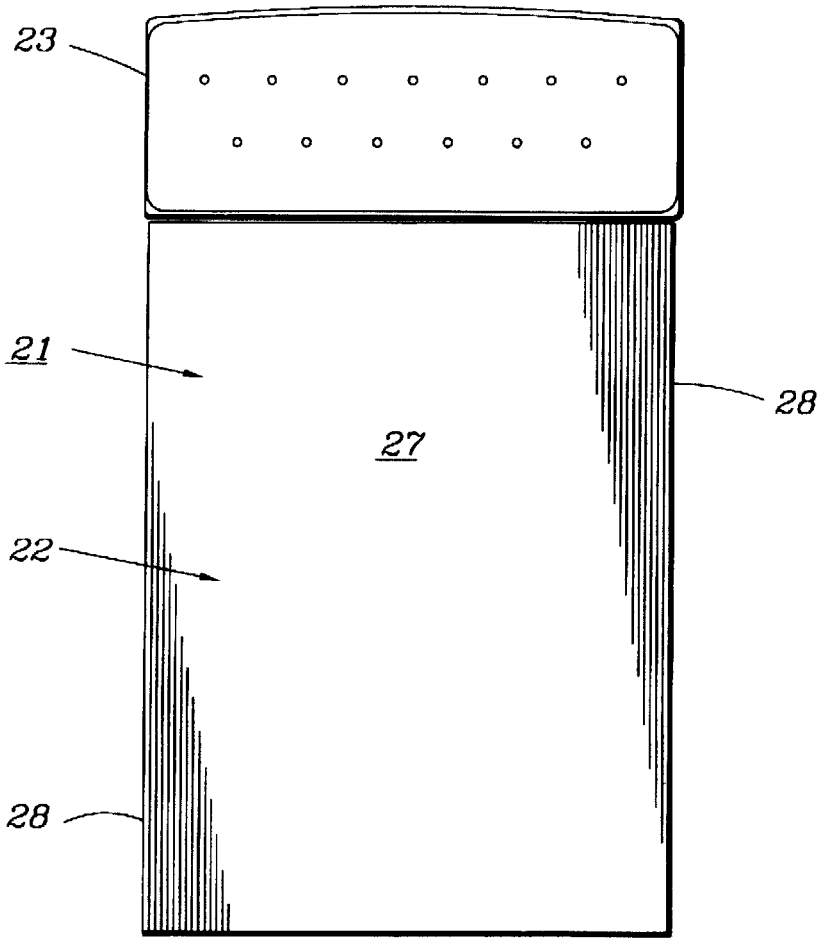
FIG. 3 is a front elevation view depicting the garment steamer employing the handle construction of the present invention.

By employing this construction, as best seen in FIGS. 2 and 4, arm portion 32, when in its stowed position, is placed in overlying, covering relationship with arm portion 35 of handle forming member 31. Similarly, arm portions 33 and 36 of handle forming members 30 and 31 are also placed in overlying covering relationship with each other in their substantial entirety, when in the stowed position. By employing this construction, a minimum area is required for arm 32, 33, 35, and 36, with this area being integrally formed as a portion of steamer 21. In this way, a virtual integrated blending of arm portions 32, 33, 35, and 36 with rear surface 24, top surface 25, and bottom surface 26 of steamer 21 is attained.

In order to enhance the nested, blended interengagement of arm portions 32, 33, 35 and 36 with steamer 21, steamer 21 preferably incorporates upper and lower shelf or recess zones formed in rear surface 24. In the preferred construction, as best seen in FIGS. 7–9, an upper shelf or recess zone is formed comprising substantially flat ledge surface 56 and wall 57 extending substantially perpendicularly from ledge surface 56. Similarly, a lower shelf or recess zone is formed by substantially flat ledge surface 58 cooperating with wall 59 extending substantially perpendicularly from ledge surface 58 of steamer 21.

In the preferred construction, ledge surface 56 comprises a width substantially equivalent to the width of arm portions 32 and 35. Similarly, ledge surface 58 comprises a width substantially equivalent to the width of arm portions 33 and 36. In this way, when handle forming members 30 and 31 of handle assembly 20 are mounted in stowed, overlying, nested interengagement, arm portions 32 and 35 are positioned in overlying, cooperating, juxtaposed, aligned relationship resting on ledge surface 56. Similarly, in the stowed configuration, arm portions 33 and 36 are mounted in juxtaposed, overlying, cooperating relationship vertically aligned with ledge surface 58.

In order to further enhance the nested, cooperating, interengagement of handle assembly 20 with steamer 21 in a manner which virtually causes handle forming members 30 and 31 to be enveloped within or fully interengaged with steamer 21, wall 57 of the upper shelf or recess zone extends from ledge surface 56 to top surface 25 of steamer 21 a distance substantially equivalent to the thickness of arm portions 32 and 35. Similarly, wall 59 of lower shelf or recess zone extends from ledge surface 58 to bottom surface 26 of steamer 21 a distance substantially equivalent to the thickness of arm portions 33 and 36.

By employing this construction, when handle forming members 30 and 31 are in their folded, stowed position, as depicted in FIGS. 2, and 4–6, handle forming members 30 and 31 essentially form an integral part of steamer 21, being inserted within the shelf or recess zones formed by ledge surfaces 56 and 58 and walls 57 and 59, substantially filling these zones. In this way, handle forming members 30 and 31 are in complete, nested, mounted interengagement with steamer 21, in a manner which causes handle forming members 30 and 31 to be substantially encompassed within and formed as an integral component of steamer 21, fully encompassed in substantially hidden interrelationship therewith. When handle forming members 30 and 31 are in this nested, stowed position, handle forming members 30 and 31 are cooperatively associated with steamer 21, causing handle forming members 30 and 31 to be a substantially integral portion of steamer 21, co-extensively interengaged and cooperatively associated with rear surface 24, top surface 25, and bottom surface 26.

In order to assure that handle forming members 30 and 31 are securely retained and locked in position when mounted in nested interengagement with steamer 21, handle forming members 30 and 31 incorporate lock means associated therewith. Although a variety of locking constructions may be employed without departing from the scope of the invention, it has been found that by forming a notch 65 in the proximal ends 40 and 42 of each arm portion directly adjacent the interconnection of the arm portion with the associated grip forming portion thereof, a lock forming member is easily attained. This construction is shown in FIGS. 5–8. In addition to each notch 65, distal ends 41 and 43 of each arm member incorporates a post 66 which is vertically aligned with each pivot pin 46 or threaded aperture 47.

Figure 6:
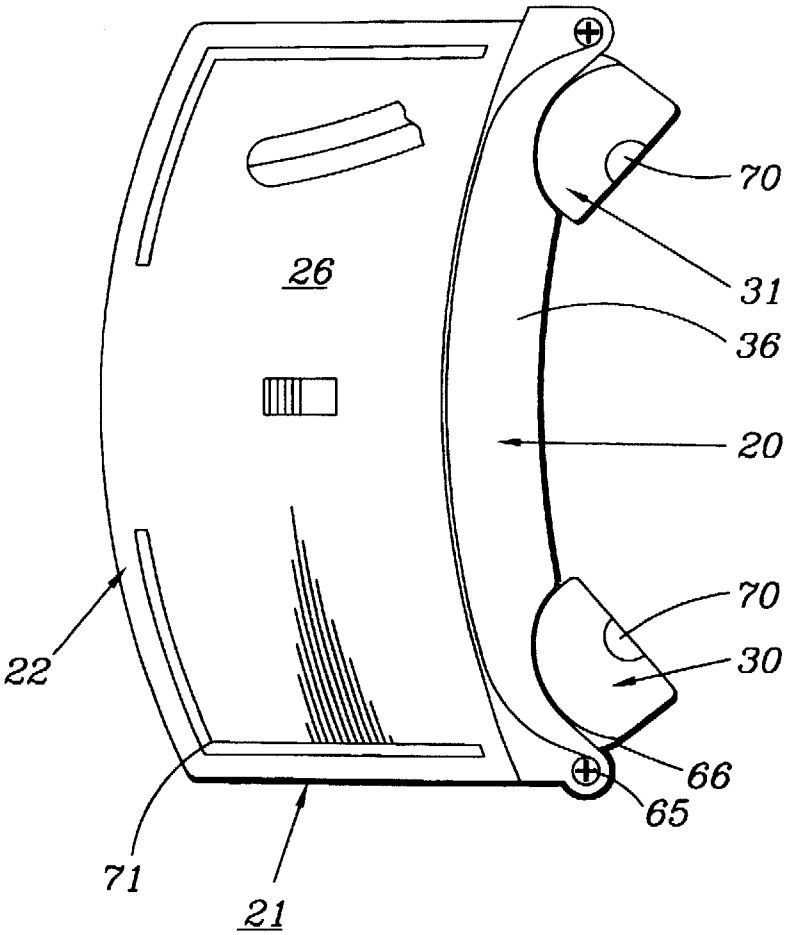
FIG. 6 is a bottom plan view depicting the handle construction of the present invention in its fully stowed, nested position in association with the garment steamer.
Figure 5:
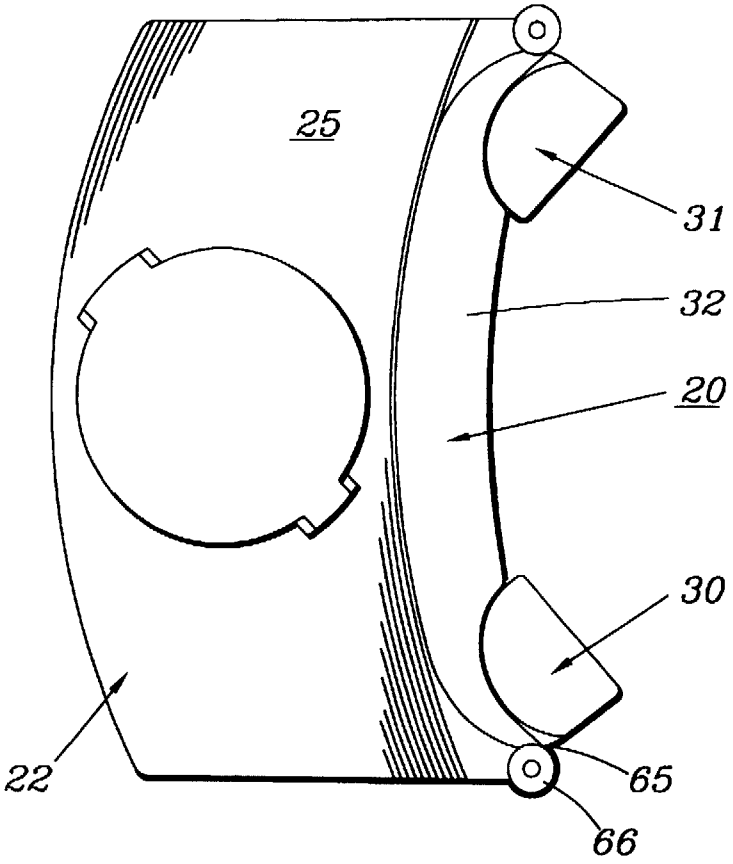
FIG. 5 is a top plan view of the handle construction of the present invention in its fully stowed position with the garment steamer wherein the head of the garment steamer has been removed.

As best seen in FIGS. 5 and 6, when handle forming members 30 and 31 are mounted in the stowed, engaged position, as depicted therein, each notch 65 is forced into frictional engagement with a post 66 which is formed on the arm portion cooperatively associated therewith. By advancing each arm portion into a fully engaged, stowed position, each notch 65 is forced into engagement with the associated post 66, securely maintaining the arm portion in the desired stowed position.

In addition, whenever arm portions 30 and 31 are to be moved into the fully deployed, grip forming position, the locked engagement of notch 65 with post 66 is easily overcome by applying pressure to each of the grip forming portions 34 and 37. In this way, each handle forming member 30 and 31 is able to be arcuately pivoted to enable grip forming portions 34 an 37 to be placed in cooperating association with each other. In this way, handle forming members 30 and 31 are quickly and easily deployed, enabling the user to attain an easily reached and accessible grip forming member, allowing the desired use of steamer 21.

A final feature incorporated in the preferred embodiment of handle assembly 20 of the present invention are extension tabs 70 mounted at the lower surface of grip forming portions 34 and 37. In the preferred embodiment, extension tabs 70 are employed to enable steamer 21 to be placed on any suitable flat surface with feet forming ribs 71 of steamer 21 and extension tabs 70 of handle assembly 20 defining a substantially similar plane, assuring the stability of steamer 21 when placed on a flat surface. In this way, wobbling or tipping of steamer 21 is substantially eliminated.

If desired, grip forming portions 34 and 37 may incorporate snap or lock means integrally associated therewith which cooperate with each other when grip forming portions 34 an 37 are mounted in the fully deployed, extended position. In this way, the gripping handle formed thereby is maintained as a substantially unitary structure for use by the consumer until separation thereof by the consumer is desired. When use of steamer 21 is completed, grip forming portions 34 and 37 are quickly and easily separated from each other, enabling each handle forming member 30 and 31 to be arcuately pivoted back to its fully engaged, stowed, integrally mounted and locked position with steamer 21, enabling storage thereof in a minimized or compacted area.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what we claim as new and desire to secure by Letters Patent is:

1. A stowable, foldable handle assembly constructed for being pivotally mounted to a product for assisting in the use of the product and comprising A. a first handle forming member comprising
  a. a grip forming portion, and
  b. at least one arm portion
    1. mounted to the grip forming portion and extending therefrom, and
    2. terminating at a distal end which is pivotally mounted to the product, defining a first pivot axis;

B. a second handle forming member comprising
  a. a grip forming portion, and
  b. at least one arm portion
    1. mounted to the grip forming portion and extending therefrom, and
    2. terminating at a distal end which is pivotally mounted to the product, defining a second pivot axis;

C. the arm portion of the first handle forming member being mounted in overlying, cooperating, interleaved relationship with the arm portion of the second handle member for enabling said first and second handle forming members to pivot relative to each other in opposite directions; and D. each of said first and second handle forming members being separately and independently pivotally movable relative to the product between a first stowed position wherein each of said handle forming members is in a nested, fully engaged position with a surface of the product, and a second extended position wherein each of said handle forming members is pivoted into juxtaposed, spaced relationship with said nesting surface, positioned for easy access and cooperative engagement for forming a handle;

whereby each of said handle forming members are independently pivotable relative to the product between the first stowed position and the second extended position, with each of the grip forming portions of each of the handle forming members being positioned for cooperation with each other to form a gripping handle for use by a consumer.

2. The stowable, foldable handle assembly defined in claim 1, and wherein A. said at least one arm portion of the first handle member further comprising first and second arm portions mounted at a first end thereof to the grip forming portion of the first handle forming member, establishing first and second juxtaposed, spaced, cooperating arm portions extending from said grip forming portion in cooperative association with each other, with the opposed, second ends of said first and second arm portions being pivotally mounted to the product for movement about the first pivot axis, and B. said at least one arm portion of the second handle member further comprising first and second arm portions mounted at a first end thereof to the grip forming portion of the second handle forming member, establishing first and second juxtaposed, spaced, cooperating arm portions extending from the grip forming portion in cooperating association with each other with the said first and second arm portion being pivotally mounted to the product for movement about the second pivot axis.

3. The handle assembly defined in claim 2, wherein the first and second arm portions mounted to the grip forming portion of the first handle forming member are further defined as being mounted at upper and lower ends of the grip forming portion of extending substantially perpendicularly therefrom and the first and second arm portions mounted to the grip forming portion of the second handle forming member are further defined as being mounted at upper and lower ends of the grip forming portion of extending therefrom substantially perpendicularly thereto.

4. The handle assembly defined in claim 3, wherein the second arm portion of the first handle forming member is further defined as being positioned in overlying, interleaved, cooperating relationship with the second arm portion of the second handle forming member, thereby enabling said arm members to pivot about their relative pivot axes in opposite directions as the first handle forming member and the second handle forming member move from their respective first stowed positions to their second fully extended positions.

5. The handle assembly defined in claim 4, wherein the pivot axis of the first handle forming member formed at said first position is located substantially along one edge of a surface of the product and the pivot axis of the second handle forming member located at said second position is substantially at the opposed end of said same surface of said product.

6. The handle assembly defined in claim 5, wherein said first position and said second position are spaced apart a distance substantially equal to the length of the arm portions.

7. The handle assembly defined in claim 6, wherein said upper arm portions and said lower arm portions are further defined as being formed for overlying each other when in the stowed position with each of the arm portions having substantially identical shapes so as to produce a substantially singular, vertical overall shape.

8. The handle assembly defined in claim 7, wherein said product incorporates a first handle receiving zone for receiving and retaining the upper arm portions when in their stowed position, thereby providing a stowed position wherein said upper arm members are virtually integrally formed with the product, visually representing a substantially continuous extension of the associated surfaces therewith.

9. The handle assembly defined in claim 8, wherein said product incorporates a second handle receiving zone for receiving and retaining the lower arm portions when in their stowed position, thereby providing a stowed position wherein said upper and lower arm members are virtually integrally formed with the product.

10. A stowable, foldable handle assembly constructed for being pivotally mounted to a product for assisting in the use of the product and comprising A. a first handle forming member comprising:
   a. a grip forming portion,
   b. a pair of arm portions each separately mounted at a first end thereof to the grip forming portion, establishing two juxtaposed, spaced, cooperating arm portions extending from said grip forming portion in cooperative association with each other, and
   c. opposed, second ends of each of said arm portions being pivotally mounted to the product at a first position and defining a first pivot axis, B. a second handle forming member comprising
   a. a grip forming portion,
   b. a pair of arm portions each separately mounted at a first end thereof to the grip forming portion, establishing two juxtaposed, spaced, cooperating arm portions extending from the grip forming portion in cooperating association with each other end, and
   c. opposed second ends of each arm portion being pivotally mounted to the product at a second position and defining a second pivot axis;

C. said first pivot axis and said second pivot axis being parallel to each other and spaced apart a distance substantially equal to the length of the arm portions; and D. each of said first and second handle forming members being separately and independently pivotally movable relative to the product between a first stowed position, wherein said handle forming member is in a nested, fully engaged position with a surface of the product, and a second extended position wherein said handle forming member is pivoted into juxtaposed, spaced relationship with said nesting surface, ready for access by the consumer, cooperatively forming a readily accessible handle;

whereby each of said handle forming members are independently pivotable relative to the product between the first stowed position and the second extended position, with each of the grip forming portions of each of the handle forming members being positioned for cooperation with each other to form a gripping handle for use by a consumer.

11. The stowable, foldable handle assembly defined in claim 10, wherein the first handle forming member and the second handle forming member are constructed for pivoting through an arc of about 45° for movement between the first stowed position and the second position.

12. The stowable, foldable handle assembly defined in claim 10, wherein said assembly further comprises:

A. lock means formed on each arm portion for maintaining the first and second handle forming members in their first stowed position.

13. The stowable, foldable handle assembly defined in claim 12, wherein said lock means is further defined as comprising post members mounted at the distal end of each arm portion and notches formed at the proximal end of each arm portion with said posts and notches constructed for cooperative, frictional interengagement for maintaining the handle forming members in the stowed position and requiring a displacement force to dislodge the handle forming members from the first stowed position when movement into the second position is desired.

14. The stowable, foldable handle assembly defined in claim 10, wherein at least one arm portion of the first and second handle forming members comprises a pin member mounted at the distal end thereof and said product incorporates a pin receiving zone for establishing a pivot zone for enabling the handle forming member to pivot relative to the product.

15. The stowable, foldable handle assembly defined in claim 14, wherein said second arm portion of said first and second handle forming members is further defined as comprising a threaded bore for cooperative association with fastening means securely affixing the distal end of said arm portion to the product and enabling said handle forming member to pivot relative thereto.

* * * * *